US006543497B2

(12) United States Patent
Dietz

(10) Patent No.: US 6,543,497 B2
(45) Date of Patent: Apr. 8, 2003

(54) WOOD FLAKE, METHOD AND APPARATUSES FOR PRODUCING A WOOD FLAKE AS WELL AS FOR PROFILING A LOG, AND USE THEREOF

(76) Inventor: Hans Dietz, Sperberweg 5, D-72119 Ammerbuch (DE)

( * ) Notice: Subject to any disclaimer, the term of this patent is extended or adjusted under 35 U.S.C. 154(b) by 0 days.

(21) Appl. No.: 09/751,043

(22) Filed: Dec. 29, 2000

(65) Prior Publication Data

US 2001/0017171 A1 Aug. 30, 2001

Related U.S. Application Data

(63) Continuation-in-part of application No. PCT/EP99/04230, filed on Jun. 18, 1999.

(30) Foreign Application Priority Data

Jun. 30, 1998 (DE) ..... 198 29 112

(51) Int. Cl.[7] ..... B27L 11/00; B27B 1/00

(52) U.S. Cl. ..... 144/373; 144/218; 144/39; 144/235; 144/369; 428/107

(58) Field of Search ..... 144/3.1, 39, 162.1, 144/174, 176, 218, 223, 235, 363, 369, 370, 373, 375; 428/102, 106, 107, 113, 191, 311.7

(56) References Cited

U.S. PATENT DOCUMENTS 6,267,164 B1 * 7/2001 Carpenter ..... 144/373

FOREIGN PATENT DOCUMENTS

| | | |
|---|---|---|
| DE | 37 02 890 A | 9/1987 |
| DE | 195 04 030 C | 7/1996 |
| EP | 0 775 558 A | 5/1997 |
| EP | 0 920 962 A | 6/1999 |

* cited by examiner

*Primary Examiner*—W. Donald Bray
(74) *Attorney, Agent, or Firm*—Weingarten, Schurgin, Gagnebin & Lebovici LLP

(57) ABSTRACT

For use as a wood intermediary and the like in industry, an essentially wedge-shaped wood flake with opposite concave and convex surfaces that converge at an imaginary tip outside the flake dimensions. The tip is located beyond the flake a distance of typically between 40% and 100% of the flake length.

21 Claims, 3 Drawing Sheets

60
62
70
74
44
72
50
76
56
54
78
21
30
10'
58
22
40
38

WOOD FLAKE, METHOD AND APPARATUSES FOR PRODUCING A WOOD FLAKE AS WELL AS FOR PROFILING A LOG, AND USE THEREOF

This is a continuation-in-part of International Application No. PCT/EP99/04230, with an international filing date of Jun. 18, 1999, which claims priority to German application No. 198 29 112.4 filed Jun. 30, 1998.

FIELD OF THE INVENTION

The present invention is related to the field of wood flake production.

More specifically, the invention is related to a wood flake having a first, concave surface and a second, convex surface delimiting between them the essentially wedge-shaped flake, the surfaces converging in an imaginary tip outside the flake, the tip being located on a centerline extending between the surfaces, and outside the flake by a centerline section.

Still more specifically, the invention is, further, related to a method of producing an essentially wedge-shaped wood flake, in which the flake is chipped from the wood by means of a rotating chipping tool, such that it comprises a first, concave surface and a second, convex surface delimiting between them the flake.

The invention, moreover, is related to a method of profiling a log, in which longitudinally extending corners are chipped from the log and side planks are sawn from the log, the side planks having a narrow surface configurated by one of the side surfaces of the corner, a saw cut being executed along the other side surface prior to chipping out the corner.

Moreover, the invention is related to an apparatus for producing an essentially wedge-shaped flake in which the flake is chipped from the wood by means of a rotating chipping tool, such that it comprises a first, concave surface and a second, convex surface delimiting between them the flake.

Further, the invention is related to an apparatus for profiling a log, comprising a chipping tool for chipping longitudinally extending corners from the log, means for sawing side planks from the log, the side planks having a narrow surface configurated by one of the side surfaces of the corner, a saw being provided for executing a saw cut along the other side surface prior to the chipping of a corner.

Finally, the invention is related to uses of the afore-mentioned wood flake, the afore-mentioned method as well as the afore-mentioned apparatus.

BACKGROUND OF THE INVENTION

In the technology of wood processing it is generally known to partially or entirely chip wood by means of so-called chipping tools. Chipping tools are conventionally rotating tools having chipping knives along their periphery. Chipping tools are conventionally mounted stationarily and the wood to be partially or entirely chipped is guided along the chipping head in an axial direction of the wood.

Due to these circumstances, the wood flakes so generated have a wing-type shape with an essentially wedge-shaped cross-section. The wood flakes are delimited on their two large surfaces by a concave and a convex side, respectively, wherein these sides extend from a thick end of the wood flake towards a narrow end or, speaking in terms of a cross-sectional view, towards a tip in which the two surfaces converge tangentially.

Wood flakes are a valuable raw material for various industrial areas. Among these are the cellulose industry, the paper industry but also manufacturers of wood materials and so-called composite components, i.e. planks, boards and beams produced by gluing together wood flakes.

These wood flake processing industries accept wood flakes according to a specific classification. Wood flakes of medium size are highly preferred because when the wood flakes are too large, they are difficult to process and, if the wood flakes are too small or too thin, then during the production of cellulose, paper, wood materials or composite components losses occur or insufficiently stable structures are obtained.

The classification of wood flakes supplied is the decisive criterion for the price which the wood processing industry is prepared to pay for such wood flakes. Therefore, within the wood processing industry there is an important demand that, during the production of wood flakes as much as possible such wood flakes shall be produced which within the classification of the wood flake processing industry given will achieve the highest price.

If wood flakes are produced by means of a rotating chipping tool, as described above in more detail, they have a thinly terminating end along their wedge-shaped cross-section. This thin end is a disadvantage for the further processing of such wood flakes because the thin end will either entirely be dissoluted within the pulp or will result in less stable areas during the production of composite components.

In practice, wood flakes are produced by either entirely chipping wood into wood flakes or by chipping wood flakes out of the wood.

A partial chipping of wood, for example, takes place in the course of the so-called profiling of logs. This term is to be understood to mean an all-side processing of the initially raw log for giving it a predetermined cross-sectional shape (profile) so that the profiled log during subsequent sawing may easily be dissected into boards and beams. A corresponding method together with an appropriate apparatus is, for example, disclosed in DE 29 28 949 A.

According to these prior art methods and apparatuses, the logs are worked by means of so-called corner millers prior to the profiling which, in an axial direction mill corners from the log so that the log, having been flattened before or being flattened thereafter, assumes a profile from which so-called side planks may be sawn away.

DE 37 02 980 C2 discloses a corresponding method together with an appropriate apparatus. According to the prior art method a first, for example horizontal saw cut of a predetermined depth is applied first from one side of the log, wherein in that case the axis of rotation of the saw blade extends vertically. After the application of the saw cut or (when a combined tool head is utilized) simultaneously thereto a partial area of the wood above the saw cut is chipped away, wherein the rotational axis of a chipping tool or, respectively, in a combined tool head the common rotational axis, extends vertically. The area chipped away does not extend as far in a horizontal direction into the log as the first saw cut is deep. Thereafter, in a further working step the residual area above the horizontal saw cut is chipped away, namely by means of a chipping tool, the rotational axis of which extends horizontally in the given example. Thereafter or together with the chipping away process step a second, vertical saw cut is applied in which the bottom of the groove so generated lies with its center where the first, horizontal saw cut was terminated within the wood. As a result, an area is worked out of the log being similar to a corner, however, being stepped at the bottom of the corner.

It is important to note at this instance that never one of the two chipping tools engages an area that had been sawn before. In this prior art method, so-called "comma chips" are exclusively generated likewise as was described above.

EP 0 770 461 A2 discloses a method and an apparatus for dissecting logs into small wood products. According to this method the log is profiled in that first the corners are entirely sawn away by means of circular saw blades having axes being oriented 90° with respect to each other. During the sawing out wood strips are generated that have to be removed from the profiling installation and have to be chipped in a separate chipping machine.

EP 0 775 558 A1 discloses a method for working logs. According to this method a band saw is first guided longitudinally through the log, the saw cut being positioned such that it separates a side plank from the log. A separator element follows the saw blade along the sawn gap so as to keep the side plank being still integrally connected to the log in a distance from the remaining wood piece. A combined edging tool follows the separator element which, as already described above, consists of a chipper and a circular saw blade connected therewith. By means of this tool, the corner area above the narrow side of the side plank to be produced is chipped away and, concurrently, the narrow side of the side plank is worked by the circular saw blade in a high surface quality. Within the chipping tool the chipping knives and the circular saw blade have the same cutting radius. The cutting circle extends tangentially relative to the broad side of the side plank to be separated, in other words, the saw teeth and the chipping knives do not run into the groove generated by the band saw acting upstream. However, also if in this prior art method the cutting circle of the chipping knives were to extend into the groove, this would have no consequences within the scope of the present invention because band saws, as well known in the art, only generate extremely narrow kerfs which, typically, have a maximum width of 3 mm. Therefore, only the outermost tips of the flakes would be affected. This, however, would only result in an unimportant modification of the flake shape. Therefore, according to this prior art method, only the already mentioned "comma chips" are generated by principle.

According to all afore-mentioned prior art methods and apparatuses, therefore, conventional wood flakes having a thinly converging end on the one hand and saw dust on the other hand, are generated.

DE 43 37 682 C1 discloses a method and an apparatus for dissecting a log.

According to the prior art method, side planks are sawn away from a laterally flattened log by means of a circular saw, the side planks being still provided at their edges with barks. These side planks, as long as they are still integrally connected with the log at their upstream end, are bent away and, thereafter, run essentially parallel to the log at a distance thereto. Within this distant position the side planks are chipped at their narrow sides by means of an edging chipper and are, hence, edged. The cutting edges of the edging chipper extend under approximately 45° angle of engagement in a radial direction through the wood when in the vicinity of the barks. The side planks, therefore, almost run in the area of the rotational axis of the edging chippers and past the latter. This is possible because, as mentioned above, the side planks at this moment are guided at a lateral distance from the main wood. The purpose of this measure is to generate so-called "uniform thickness chips" during the edging of the side planks having been bent away before, i.e. chips which, in contrast to the so-called "comma chips" have an essentially constant thickness parallel to the wood fiber. These "uniform-thickness-chips" have approximately the cross-sectional shape of a parallepiped, the corner angle of which being about 45° (and 135°, respectively) because the plane of engagement of the chipper on the wood lies, as mentioned above, under approximately 45° relative to the direction of movement of the side plank.

This prior art method and the corresponding apparatus, therefore, have the advantage to generate chips being advantageously configured for a subsequent processing within the cellulose industry, however, this disadvantage may only be obtained with substantial additional efforts because the side planks have to be bent away from the sawing plane and have to be edged in a significant distance from the main wood. However, this is not possible in the same manner for all woods, at least not without damaging the fiber of the side plank during the bending away.

It is, therefore, an object underlying the invention to improve a wood flake as well as methods and apparatuses of the type specified at the outset and the above-mentioned uses, respectively, such that the afore-mentioned disadvantages are avoided. In particular, it shall become possible to produce wood flakes in an economically optimum manner and with a shape corresponding exactly to those classes of wood flakes for which the wood flake processing industry is ready to pay the highest prices.

SUMMARY OF THE INVENTION

In a wood flake of the type specified at the outset, this object is achieved according to the invention in that the length of the centerline section lying outside the flake has between 40% and 100% of the length of the centerline section inside the flake.

In a method of producing a wood flake of the type specified at the outset, this object is achieved according to the invention in that prior to the chipping the wood is removed in the area in which the surfaces converge in an imaginary tip.

In a method of profiling a log of the type specified at the outset, this object is achieved according to the invention in that the chipping tool has a cutting radius extending into the groove generated by the saw cut and running free therein.

In an apparatus for producing a wood flake of the type specified at the outset, this object is achieved according to the invention in that means are provided for removing the wood in the area in which the surface is converged in an imaginary tip prior to the chipping.

In an apparatus for profiling a log of the type specified at the outset, this object is achieved according to the invention in that the chipping tool has a cutting radius extending into the groove generated by the saw cut such that it runs fee therein.

Moreover, this is object is achieved by the use of the afore-mentioned wood flakes as strands during the production of composite beams or planks.

Further solutions according to the invention consist in the use of the afore-mentioned method as well as the afore-mentioned apparatus for chipping out edges during the profiling of logs.

The object underlying the invention is thus entirely solved.

In contrast to conventional, wedge-shaped chips having a thinly extending terminal end or tip, respectively, the invention suggests to remove that thinly terminating end so that only the thicker end of the wood flake survives.

A shortened wood flake of that kind has much more economical value and, hence, may be processed much more advantageously. The operator of a saw mill may, hence, expect a significantly higher economical yield during the processing of wood flakes if wood flakes of that shape are used.

The fact that the tip lies on a centerline of the chip extending between the surfaces, and outside the wood flake by a centerline section, the length of which being between 40% and 100% of the length of the centerline section within the wood flake has the advantage that a wood flake is provided being exactly shortened to an extent being an economical optimum.

Moreover, it is preferred when the centerline at the junction between the centerline sections intersects the flake in a boundary surface. The boundary surface, preferably, and the centerline enclose between them a thinned angle so that, still more preferably, the wood flake has a thickness of between 2 and 10 mm between the surfaces at the transition between the convex surface and the boundary surface.

These dimensions, too, have the advantage that a wood flake is generated that may be exploited under optimum economical conditions.

The considerations made above in connection with the embodiments discussed before, likewise apply for corresponding embodiments of the inventive method as well as for the inventive apparatus.

Moreover, it is particularly preferred when the boundary surface is plane. Preferably, this is effected by making the boundary surface through sawing.

The saw, preferably, is configured as a circular saw having a circular saw blade of more than 5 to 6 mm thickness. The circular saw is, still more preferably, followed by a wood cleaver extending between the saw and the chipping tool.

This measure opens up the possibility to prepare during one and the same operational step the wood to be entirely or partially chipped by a cut, in particular by a saw cut, such that for a subsequent engagement of the rotating chipping tool the afore-mentioned shortened wood flakes are generated, almost immediately because that area had been removed before in which the thinly converging ends or tips, respectively, would have been made.

Further advantages will become apparent from the drawing and the enclosed description.

It goes without saying that the features mentioned before and those that will be explained hereinafter may not only be used in the particularly given combination, but also in other combinations or alone without leaving the scope of the present invention.

BRIEF DESCRIPTION OF THE DRAWINGS

Embodiments of the invention are shown in the drawing and will be discussed in more detail in the subsequent description.

DETAILED DESCRIPTION OF THE PREFERRED EMBODIMENTS

Figure 1:
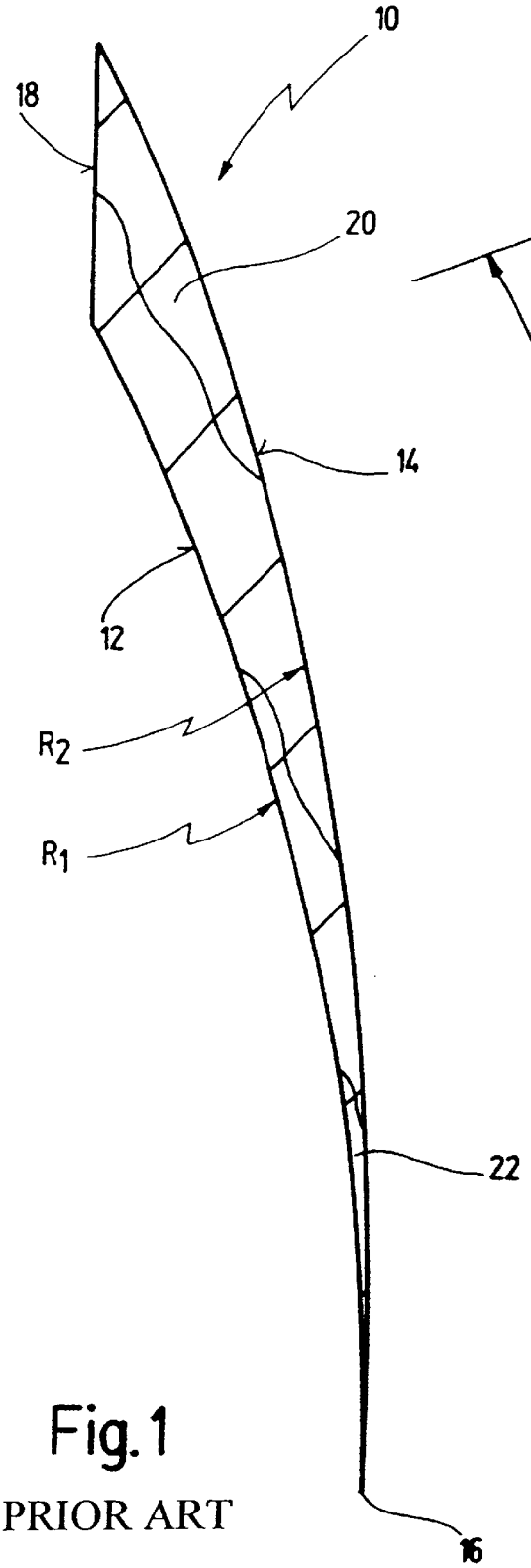
Fig. 1 PRIOR ART
FIG. 1 shows a cross-sectional view of a wood flake as produced with conventional chipping tools.

In FIG. 1 reference numeral 10 designates a conventional wood flake. Wood flake 10 has two sides or surfaces 12, 14, respectively, extending under right angles relative to the plane of the drawing and configurating essentially the surface of wood flake 10. The left hand surface 12 in FIG. 1 is concave and the right hand surface 14 is convex. Surfaces 12 and 14 converge tangentially at the bottom of FIG. 1 in a tip 16 or edge, respectively. At the opposite end of wood flake 10, a preferably plane or flat front face 18 may be seen. Would flake 10, seen as a whole, therefore, has a thick end 20 and a thin end 22.

Wood flakes of the kind of wood flake 10 according to FIG. 1 rise problems during the processing in the cellulose industry or in the industry producing composite components, in particular beams and planks, respectively, because the thinner end 22 has no own stability and will be diluted during the processing within a liquid medium or will be destroyed when a stronger mechanical load is exerted thereon, so that undefined fragments remain.

The economical value of wood flake 10 may, hence, be substantially increased if thinner end 22 is removed.

Figure 2:
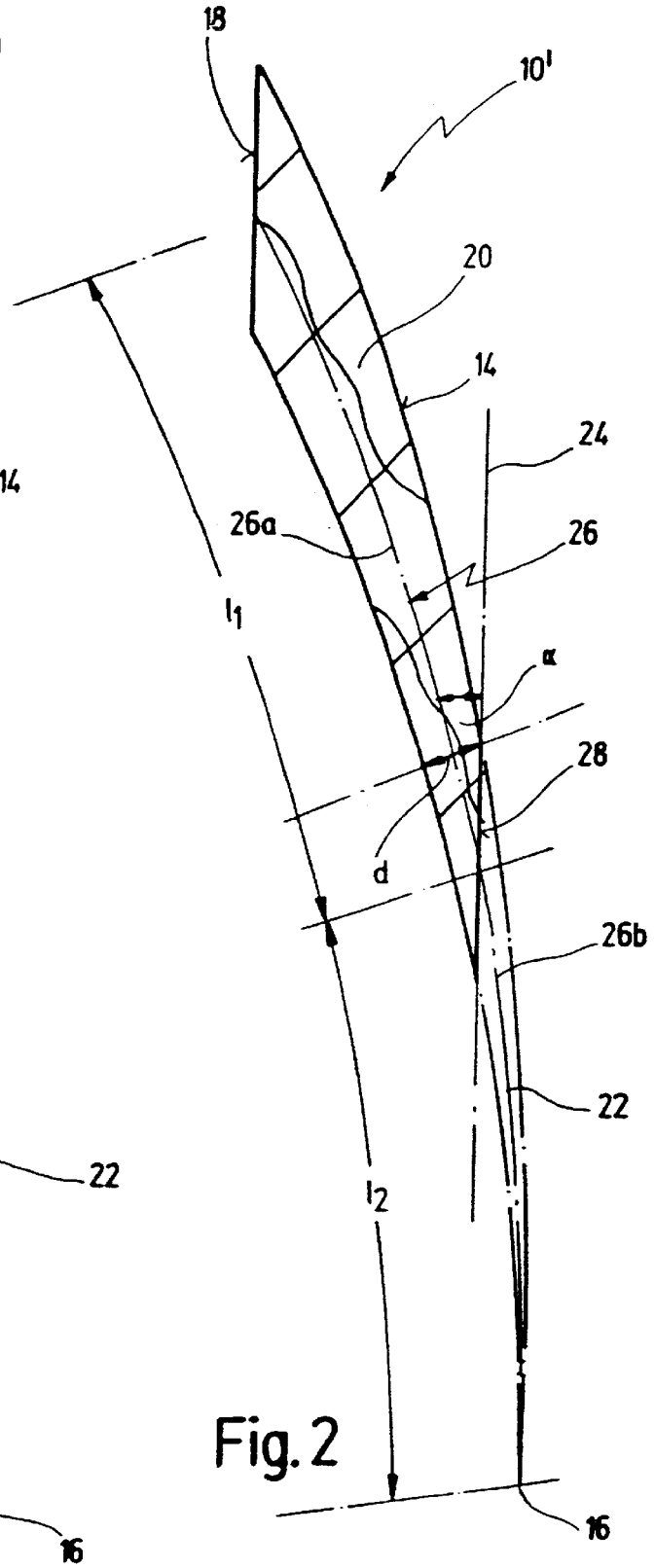
FIG. 2 is an illustration, similar to that of FIG. 1, however, for a wood flake produced according to the present invention.

This is effected in the embodiment of the invention shown in FIG. 2 in that a cut is executed through wood flake 10 along a separation plane 24, such that thinner end 22 is removed.

The position of separation plane 24 within wood flake 10' may be determined in various ways. First of all, economical considerations are of importance, i.e. the question in which remaining configuration wood flake 10' has the best economical yield. Typically, the lateral distance of separation plane 24 from tip 16 is, for example, 6 mm.

Now, if a centerline 26 is drawn between surfaces 12 and 14, one may define a centerline section **26*a* within remaining wood flake 10' and having a length $l_1$ and, further, an imaginary centerline section 26*b* outside remaining wood flake 10', namely down to tip 16 and having a length $l_2$, wherein the entire length of the original wood flake 10 is $l_1+l_2$. The optimum position of separation plane 24 is, for example, obtained when $l_2$ is between 40% and 100% of $l_1$. Still another possibility of definition consists in defining the thickness d of remaining wood flake 10' at the transition between convex surface 24 to a boundary surface 28 along separation plane 24** to be e.g. between 2 and 10 mm.

In the embodiment shown in FIG. 2, boundary surface 28 encloses an acute angle a with centerline 26 which, e.g. may be between 15° and 50°.

In preferred embodiments of the invention, the flat front face 18 is generated by chipping or sawing and boundary surface 28 is generated by sawing in an axial direction. Hence, they are both plane and extend parallel with respect to each other.

Figure 3:
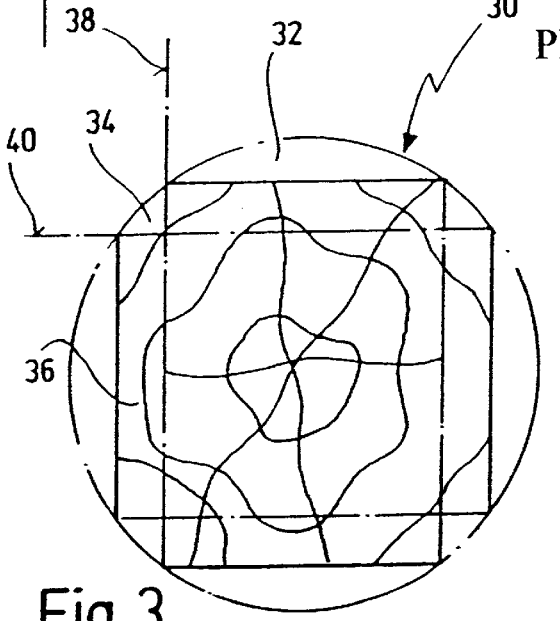
FIG. 3 is a schematic radial cross-sectional view of a log for explaining a profiling process.

In FIG. 3 reference numeral 30 in dash-dot lines indicates the essentially circular radial cross-section of a log. The lateral sides of log 30 are provided with so-called barks 32, i.e. bark-bearing surface sections.

So-called corners 34 are provided at four peripheral positions of log 10 being equally spaced with respect to each other by 90°. If barks 32 (conventionally by chipping) and corners 34 (conventionally by milling or chipping, respectively) are removed, a so-called model remains from which subsequently side planks 36 and, further, other planks and/or a so-called main wood may be sawn.

In FIG. 3 reference numerals 38 and 40 designate the two side surfaces of corner 34.

Figure 4:
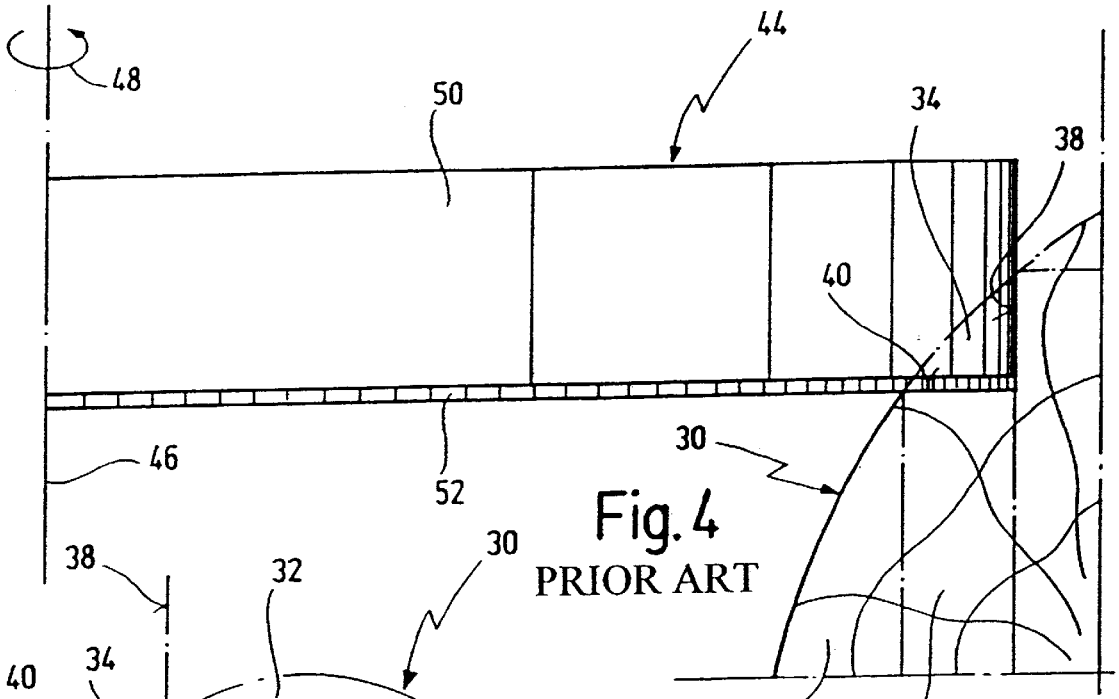
Fig. 4 PRIOR ART
FIGS. 4 and 5 show extremely schematic views of an apparatus for producing conventional wood flakes.

FIG. 4 on a highly enlarged scale again shows the area of a corner 34 of log 30. For producing the corners, a corner milling tool 44 or, in more general terms, a rotating chipping tool, is used. Corner milling tool 44 is adapted to be rotated about an axis 46 and in the direction of an arrow 48. Axis 46 extends under right angles relative to the longitudinal axis of log 30.

Corner milling tool 44 is composed from two tools, as known per se, namely a chipper 50 as well as a saw blade 52 or a corresponding number of planing knives.

During the rotation of corner milling tool 44 (arrow 48), the knives of chipper 50 enter into corner 34 in the area of first side surface 38, while, concurrently, second side surface 40 of corner 34 is processed by saw blade 52 or the planing knives, respectively.

By doing so, second side surface 40 is provided with a relatively high (sawn) surface quality, whereas second side surface 38 is provided with an undulated surface due to the chipping knives rotating together with the rotational movement.

Figure 5:
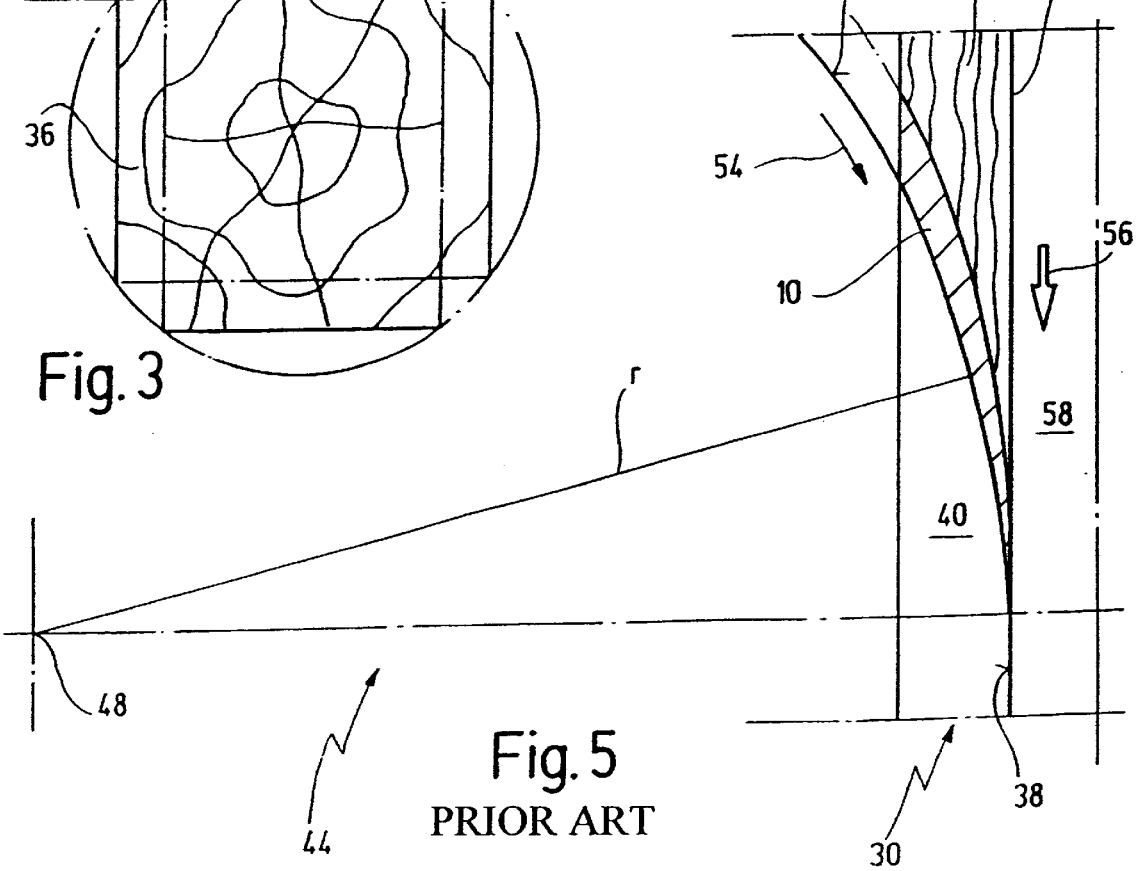
Fig. 5 PRIOR ART

FIG. 5 shows a top plan view on the assembly of FIG. 4. An arrow 54 indicates the rotational movement of corner milling tool 44 rotating about axis 48. The radius of corner milling tool 44 is designated by r.

An arrow 56 designates the feed direction of log 30 relative to corner milling tool 44 journaled stationarily (or vice versa). The top plan view of FIG. 5 further, shows a flattened area 58 on log 50 where corresponding bark 32 had been removed before by lateral flattening. Flattened area 58 is separated from the remaining bark area 62 by an axial extending transition line 60 in which corner 34 shall be executed by means of corner milling tool 44.

As may be clearly seen from FIG. 5, this conventional approach results in the production of a wood flake 10 according to FIG. 1.

Figure 6:
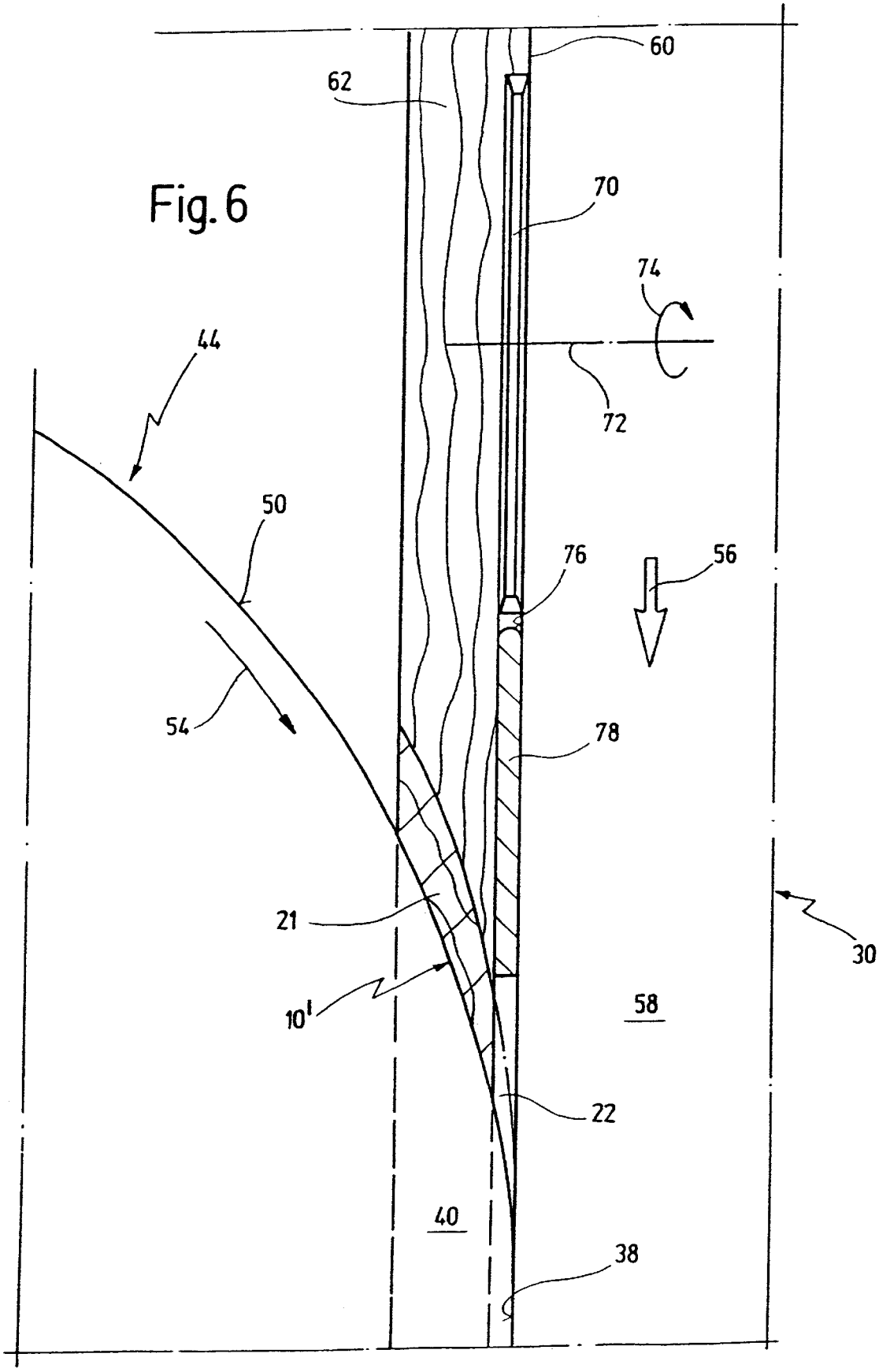
FIG. 6 is a depiction, similar to that of FIG. 5, however, on an enlarged scale and showing an embodiment of an apparatus according to the present invention for producing inventive wood flakes.

In contrast, the inventive assembly according to FIG. 6 has a circular saw blade 70 upstream rotating corner milling tool 44. Circular saw blade 70 rotates about an axis 72 as indicated by an arrow 74. Axis 72 extends under right angles relative to the longitudinal axis of log 30. As a consequence, circular saw blade 70 saws a first groove or kerf 76 along transition line 60. Circular saw blade 70, typically, has a thickness in excess of 5 mm, preferably in excess of 6 mm, so that groove 76 is correspondingly wide, in any event substantially wider as in the case of a band saw. Circular saw blade 70 may be provided with particularly wide teeth, as the individual case may be.

A wood cleaver 78 may follow circular saw blade 70. Wood cleaver 78, as viewed in an axial direction, ends where the area of engagement of corner milling tool 44 begins.

The arrangement is made such that groove 76 is made at a position where thin end 22 of the wood flake would lie in conventional processes (FIG. 5). Due to the fact that the wood in that area had been removed before by means of circular blade 70, chipping knives of chipper 50 of corner milling tool 44 as well as saw blade 52 or the corresponding planing knives, respectively, run freely therein.

As a consequence, wood flake 10' is produced without thinner end 52 and, hence, only consists of thicker end 20.

It goes without saying that circular saw blade 70 is to be understood only as an example and that, of course, other chipping tools may likewise be used, if, for example, the width of groove 76 shall be bigger.

The mode of operation shown in FIG. 6, further, yield the additional advantage that first side surface 38 may be configurated with a surface in saw quality from the beginning on.

What is claimed is:

1. An essentially wedge-shaped wood flake having a first, concave surface and a second, convex surface delimiting between them said flake, said first and second surfaces converging in an imaginary tip outside said flake, said flake having a center line extending between said first and second surfaces and comprising a first center line section of a first length extending inside said flake and a second center line section of a second length extending outside said flake, said tip being located on said center line, and outside said flake at a terminal end of said second center line section, wherein said second length is between 40% and 100% of said first length.

2. The flake of claim 1, wherein said center line intersects said flake in a boundary surface at a junction between said first and second center line sections.

3. The flake of claim 2, wherein said boundary surface and said center line enclose a finite angle between them.

4. The flake of claim 2, wherein said flake has a thickness of between 2 and 10 mm between said first and second surfaces at a transition between said second surface and said boundary surface.

5. The flake of claim 2, wherein said boundary surface is plane.

6. The flake of claim 2, wherein said center line intersects said flake in a front face at an end opposite said boundary surface, said front face extending parallel to said boundary surface.

7. A method of producing an essentially wedge-shaped wood flake from a log by chipping, said flake comprising a first, concave surface and a second, convex surface delimiting between them said flake, said first and second surfaces converging in an imaginary tip within a converging area, said flake having a center line extending between said first and second surfaces and comprising a first center line section of a first length extending inside said flake and a second center line section of a second length extending outside said flake, said tip being located on said center line, and outside said flake at a terminal end of said second center line section, the method comprising the steps of:

a) removing wood from said log in said converging area and;

b) chipping said flake from said log by means of a rotating chipping tool, wherein said chipping tool is guided to extend so far into said removed converging area that said second length is between 40% and 100% of said first length.

8. The method of claim 7, wherein said center line intersects said flake in a boundary surface at a junction between said center line sections.

9. The method of claim 8, wherein said boundary surface is produced such that said boundary surface encloses with said center line a finite angle.

10. The method of claim 8, wherein said flake is chipped out with a thickness of between 2 and 10 mm between said first and second surfaces at a transition between said second surface and said boundary surface.

11. The method of claim 8, wherein said boundary surface is produced in a plane configuration.

12. The method of claim 11, wherein said boundary surface is produced by sawing.

13. The method of claim 8, wherein said center line intersects said flake in a front face at an end opposite said boundary surface, said plane face extending parallel to said boundary surface.

14. A method of profiling a log, comprising the steps of:

a) generating a saw cut along said log for generating a groove therein;

b) guiding a rotating chipping tool along said groove for chipping from said log longitudinally extending corners having first and second side surfaces, said chipping tool having a cutting radius extending into said groove and running free therein, said second side surface extending along said saw cut, flakes being produced during said chipping comprising a first, concave surface and a second, convex surface delimiting between them said flake being essentially wedge-shaped, said first and second surfaces converging in an imaginary tip, said flake having a center line extending between said first and second surfaces and comprising a first center line section of a first length extending inside said flake and a second center line section of a second length extending outside said flake, said tip being located on said center line, and outside said flake at a terminal end of said second center line section, wherein said chipping tool is guided along said groove such as to extend so far into said groove that said second length is between 40% and 100% of said first length; and c) sawing off side planks from said log, said side planks having a narrow surface configurated by one of said side surfaces.

15. An apparatus for producing an essentially wedge-shaped wood flake from a log by chipping, said flake comprising a first, concave surface and a second, convex surface delimiting between them said flake, said first and second surfaces converging in an imaginary tip within a converging area, said flake having a center line extending between said first and second surfaces and comprising a first center line section of a first length extending inside said flake and a second center line section of a second length extending outside said flake, said tip being located on said center line, and outside said flake at a terminal end of said second center line section, the apparatus comprising:

a) means for removing wood from said log in said converging area; and b) means for chipping said flake from said log by means of a rotating chipping tool, wherein said chipping tool is guided to extend so far into said removed converging area that said second length is between 40% and 100% of said first length.

16. The apparatus of claim 15, wherein said removing means comprise a saw.

17. The apparatus of claim 16, wherein said saw is configured as a circular saw having a circular saw blade.

18. The apparatus of claim 17, wherein said circular saw blade has a thickness of at least 5 mm.

19. The apparatus of claim 17, wherein said circular saw blade has a thickness of at least 6 mm.

20. The apparatus of claim 16, wherein a wood cleaver is provided between said saw and said chipping tool, said wood cleaver extending flush with said saw.

21. An apparatus for profiling a log, comprising:

a) means for generating a saw cut along said log for generating a groove therein;

b) means for guiding a rotating chipping tool along said groove for chipping from said log longitudinally extending corners having first and second side surfaces, said chipping tool having a cutting radius extending into said groove and running free therein, said second side surface extending along said saw cut, flakes being produced during said chipping comprising a first, concave surface and a second, convex surface delimiting between them said flake being essentially wedge-shaped, said first and second surfaces converging in an imaginary tip, said flake having a center line extending between said first and second surfaces and comprising a first center line section of a first length extending inside said flake and a second center line section of a second length extending outside said flake, said tip being located on said center line, and outside said flake at a terminal end of said second center line section, wherein said chipping tool is guided along said groove such as to extend so far into said groove that said second length is between 40% and 100% of said first length; and c) means for sawing off side planks from said log, said side planks having a narrow surface configurated by one of said side surfaces.

* * * * *